US006049319A

United States Patent [19]

Sakamoto et al.

[11] Patent Number: 6,049,319

[45] **Date of Patent: *Apr. 11, 2000**

[54] LIQUID CRYSTAL DISPLAY

[75] Inventors: Atsushi Sakamoto, Nara; Kouki Taniguchi, Ikoma, both of Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/535,554

[22] Filed: Sep. 28, 1995

[30] Foreign Application Priority Data

Sep. 29, 1994 [JP] Japan ..... 6-235069

[51] Int. Cl.[7] ..... G09G 3/18

[52] U.S. Cl. ..... 345/94; 345/58; 345/208

[58] Field of Search ..... 349/102, 121; 345/58, 87, 94, 95, 96, 100, 208, 209, 210

[56] References Cited

U.S. PATENT DOCUMENTS

| | | | |
|---|---|---|---|
| 4,818,981 | 4/1989 | Oki et al. | 345/94 |
| 4,926,168 | 5/1990 | Yamamoto et al. | 345/96 |
| 4,945,352 | 7/1990 | Ejiri | 345/58 |
| 4,985,698 | 1/1991 | Mano et al. | 345/88 |
| 5,151,690 | 9/1992 | Yamazaki | 345/96 |
| 5,196,839 | 3/1993 | Johary et al. | 340/793 |
| 5,298,912 | 3/1994 | Mano et al. | 345/94 |
| 5,307,084 | 4/1994 | Yamaguchi et al. | 345/58 |
| 5,309,150 | 5/1994 | Ohba et al. | 345/208 |
| 5,365,284 | 11/1994 | Matsumoto et al. | 345/100 |
| 5,400,049 | 3/1995 | Yoshii | 345/97 |
| 5,583,528 | 12/1996 | Ebihara | 345/58 |
| 5,625,373 | 4/1997 | Johnson | 345/58 |
| 5,666,132 | 9/1997 | Ochi et al. | 345/96 |
| 5,841,410 | 11/1998 | Oda et al. | 345/58 |

FOREIGN PATENT DOCUMENTS

| | | |
|---|---|---|
| 2039022 | 2/1990 | Japan . |
| 2-171718 | 7/1990 | Japan . |
| 4-276794 | 10/1992 | Japan . |
| 4-348385 | 12/1992 | Japan . |
| 6-12030 | 1/1994 | Japan . |

*Primary Examiner*—Lun-Yi Lao

*Attorney, Agent, or Firm*—Dike, Bronstein, Roberts & Cushman, LLP; David G. Conlin; William J. Daley, Jr.

[57] ABSTRACT

A liquid crystal display is provided with: a liquid crystal panel having a liquid crystal layer that is disposed between signal electrodes and scanning electrodes, a signal-side driving circuit which applies binary voltages representative of data to be displayed on the liquid crystal panel to the signal electrodes, a scanning-side driving circuit which successively applies scanning voltages to the scanning electrodes, a control circuit which controls the signal-side driving circuit so that rounded waveforms of voltages to be respectively applied to the signal electrodes are made virtually constant, and a compensation circuit which eliminates voltage distortions that are induced with respect to non-selected scanning electrodes, when the signal-side driving circuit is controlled. With this arrangement, it becomes possible to positively reduce the two types of crosstalk and also to achieve liquid crystal displays which have high display quality and are capable of making less conspicuous flickers and beats due to irregularly distorted waveforms which still remain slightly.

13 Claims, 17 Drawing Sheets

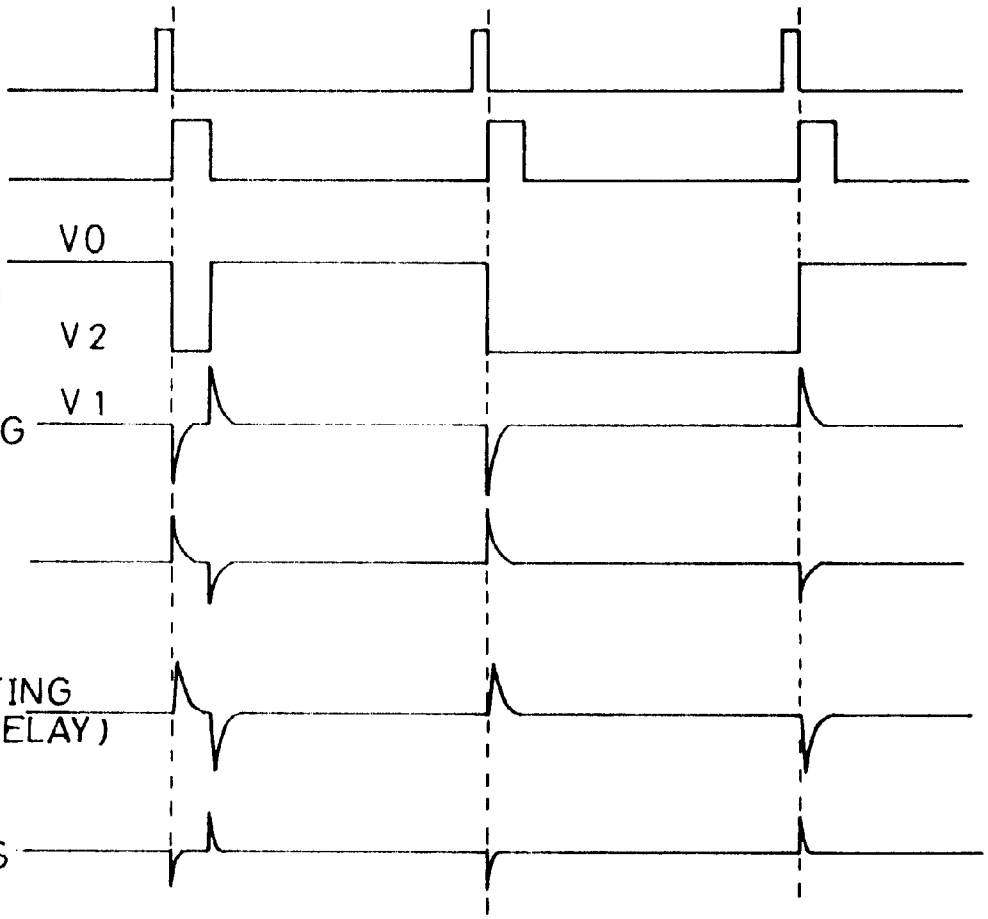
FIG. 6 (a) LP
FIG. 6 (b) SLT
FIG. 6 (c) WAVEFORM APPLIED TO SIGNAL ELECTRODES
V0
V2
FIG. 6 (d) WAVEFORM DISTORTION INHERENT TO SCANNING ELECTRODES
V1
FIG. 6 (e) CURRENT i
FIG. 6 (f) OUTPUT OF COMPENSATING VOLTAGE (WITH LOOP DELAY)
FIG. 6 (g) WAVEFORM APPLIED TO SCANNING ELECTRODES AFTER COMPENSATION

LP
1 2 3 4 5 6 7 8 1 2 3 4 5 6 7 8 1

FR

X2

X3

X6

Y2

X2-Y2

X3-Y2

X6-Y2

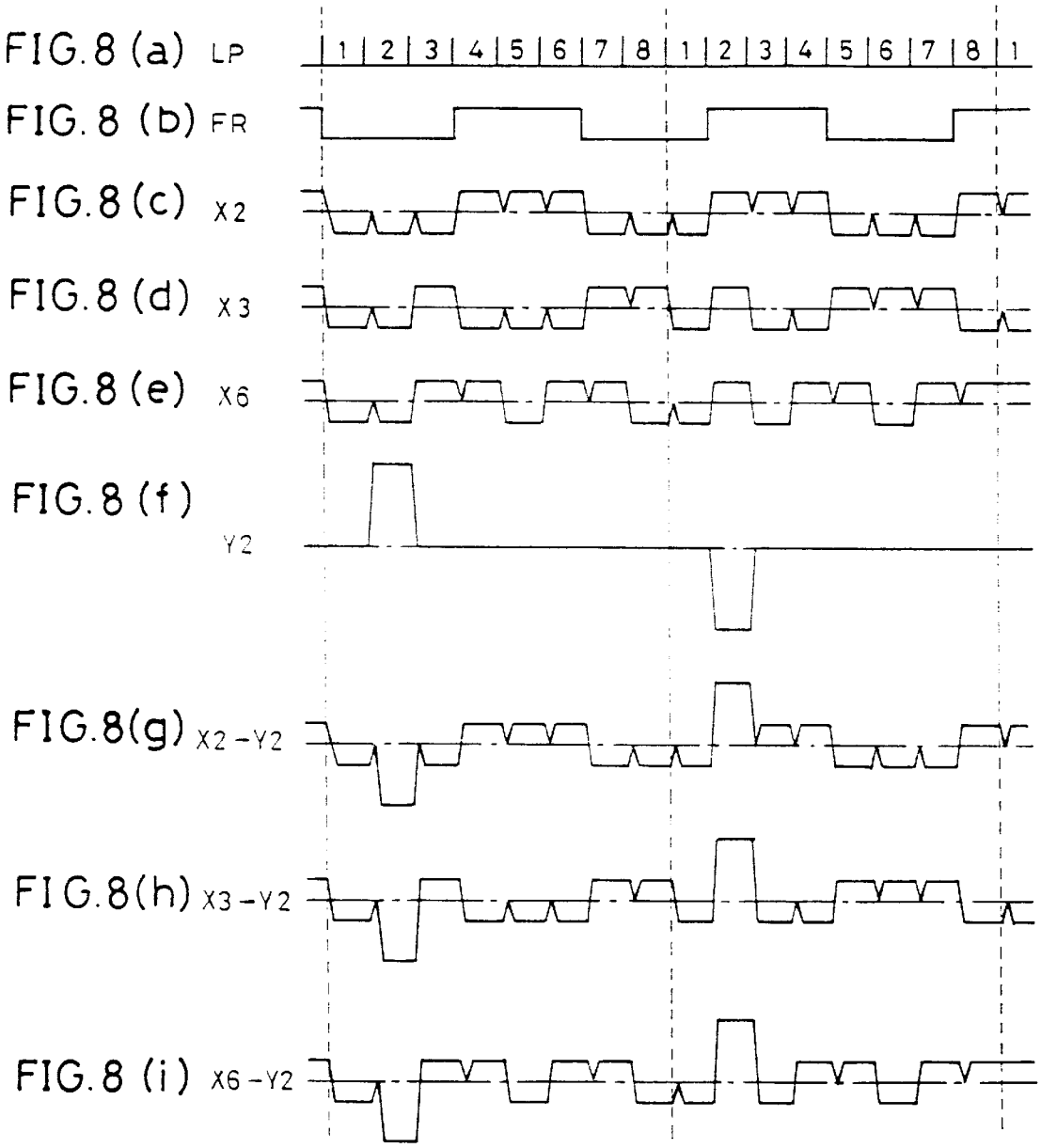
FIG.8 (a) LP
1 2 3 4 5 6 7 8 1 2 3 4 5 6 7 8 1
FIG.8 (b) FR
FIG.8 (c) X2
FIG.8 (d) X3
FIG.8 (e) X6
FIG.8 (f) Y2
FIG.8(g) X2-Y2
FIG.8(h) X3-Y2
FIG.8 (i) X6-Y2

INVERSION DUE TO DISPLAY DATA
LP
V2
V3
V4
OPTIMAL WAVEFORM
ACTUAL WAVEFORM (SHADED PORTION CORRESPONDING TO EFFECTIVE VALUE)

CONTINUOUS DISPLAY DATA (WITH INVERSION PERIOD)

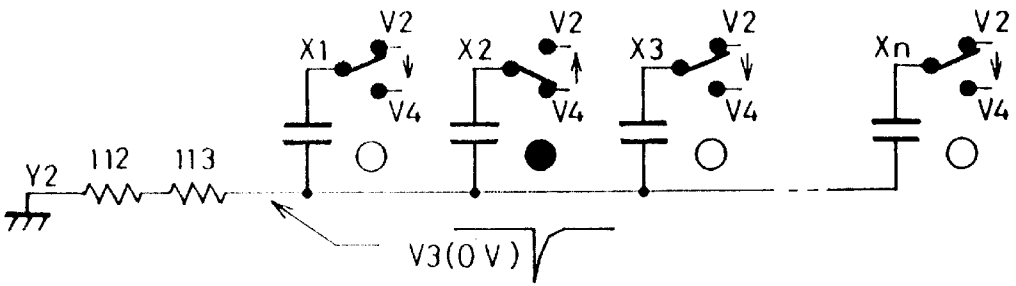
FIG.15(a) PRIOR ART FR↑UPON
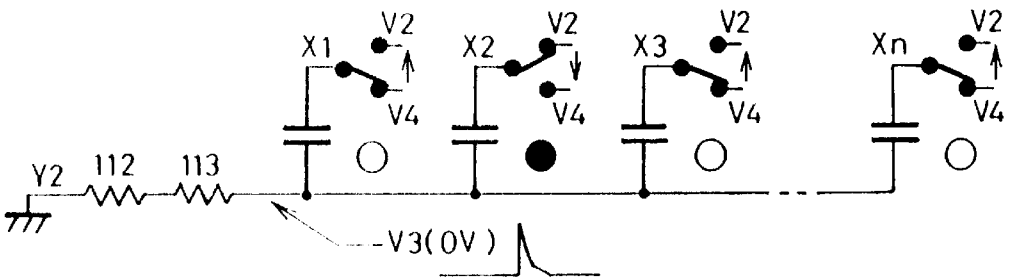
FIG.15(b) PRIOR ART FR↓UPON

LIQUID CRYSTAL DISPLAY

FIELD OF THE INVENTION

The present invention relates to liquid crystal displays using simple-matrix-type liquid crystal panels that are driven by the averaged voltage method.

BACKGROUND OF THE INVENTION

Recently, with the widespread use of personal computers, word processors and other apparatuses, liquid crystal displays have been widely adopted as their display devices instead of power-consuming, large-size CRTs, because they are thin and light and because they are also driven by batteries.

Driving methods for liquid crystal displays are generally classified into two types, the simple-matrix type and the active-matrix type. It is comparatively difficult to produce liquid crystal displays of the active-matrix type because non-linear elements are required for respective pixels that are arranged in the form of a matrix. Therefore, at present, those of the simple-matrix type are generally used for liquid crystal displays with large display capacities.

In the liquid crystal displays of the simple-matrix type, however, irregularity in display (crosstalk), which is dependent on display patterns, tends to occur as their display capacity increases due to their inherent characteristic, and this tends to cause degradation in display quality.

The following description will discuss the irregularity in display by using as an example a conventional liquid crystal display of the simple-matrix type using the averaged voltage method.

As illustrated in FIG. 13, the liquid crystal display is provided with: a liquid crystal panel 101 having a plurality of scanning electrodes Y1 through Y8 and a plurality of signal electrodes X1 through X8 which are arranged in a manner orthogonally intersecting one another; a scanning-side driving circuit 103 for successively applying voltages to the scanning electrodes Y1 through Y8; a signal-side driving circuit 102 for applying signal voltages representative of display data to the signal electrodes X1 through X8; a power-source circuit 104 for generating voltages required for the driving operation; and a control circuit 105 for controlling the scanning-side driving circuit 103 and the signal-side driving circuit 102.

The scanning electrodes Y1 through Y8 are successively scanned, and when selected, they are subjected to selected voltages applied from the power source circuit 104, and when not selected, they are subjected to non-selected voltages applied from the power source circuit 104. The signal electrodes X1 through X8 are, on the other hand, subjected to an on-voltage or an off-voltage that is applied from the power source circuit 104 depending on display data so as to drive the electrodes. Here, for convenience of explanation, it is assumed in the following explanation that eight scanning electrodes and eight signal electrodes are respectively provided, that these electrodes are driven by one eighth duty, and that the signal-reversing cycle for ac-based drive is three scanning lines.

The power source circuit 104 generates not only driving voltages V2 and V4 to be applied to the signal-side driving circuit 102, but also driving voltages V1, V3 and V5 to be applied to the scanning-side driving circuit 103. Further, the control circuit 105 releases to the signal-side driving circuit 102, a display data D, a data-shift clock CK, a scanning clock LP, a scanning start signal FLM, and an ac-conversion signal FR, as well as releasing to the scanning-side driving circuit 103, a scanning clock LP, a scanning start signal FLM, and an ac-conversion signal FR.

Referring to timing charts shown in FIGS. 14(*a*) through 14(*g*), the following description will discuss the operations of the respective driving circuits in the liquid crystal display having the above-mentioned arrangement.

FIGS. 14(*a*) through 14(*g*) show optimal waveforms of voltages that are applied to respective pixel A (an intersection of signal electrode X2 and scanning electrode Y2), pixel B (an intersection of signal electrode X3 and scanning electrode Y2) and pixel C (an intersection of signal electrode X6 and scanning electrode Y2) on the liquid crystal panel shown in FIG. 13. Here, on the liquid crystal panel of FIG. 13, pixels indicated by white circles are on-state elements, and pixels indicated by black circles are off-state elements. In the optimal stage, equal effective voltages are respectively applied to pixels A, B and C, and it is supposed that no variations occur in the transmittance of the liquid crystal display panel.

However, in an actual operation in a liquid crystal panel, irregularity in display (crosstalk) tends to occur as described below. Let us suppose that longitudinal black block displays in a while background or alternative black and white displays in a stripe are made as shown in FIG. 13. Pixels located on the same signal line as the longitudinal block portion (for example, pixel B) become brighter than the other background portion (for example, pixel A) (as indicated by slanting lines in FIG. 13), while pixels located on the same signal line as the alternative black and white stripe portion (for example, pixel C) become darker than the other background portion (for example, pixel A) (as shown by cross-hatching in FIG. 13).

The crosstalk of this type, which causes serious degradation in display quality, forms a major problem to be solved in the liquid crystal displays of the simple-matrix type. The following description will discuss causes of the crosstalk; however, the crosstalk which appears in the block portion and that which appears in the alternative black and white stripe portion differ from each other in their causes. Therefore, for convenience of explanation, the former is referred to as crosstalk of A type, and the latter is referred to as crosstalk of B type.

First, an explanation will be given on the cause of the crosstalk of A type.

FIGS. 15(*a*) and 15(*b*) show modified models wherein Y2 line is simplified and each liquid crystal pixel, which is a capacitive element, is substituted by a capacitor. Here, a resistor 112 shows an output ON resistor of the scanning-side driving circuit 103 which is normally constituted of ICs. A resistor 113 shows an equivalent resistor of the scanning electrode Y2 which is normally constituted of transparent electrodes such as ITOs.

As shown in FIG. 15(*a*), upon the rising of the ac-conversion signal FR, a downward waveform distortion occurs in Y2 line due to a transient response, since the majority of the signal electrodes except X2 and so on are subjected to a switchover from voltage V2 to voltage V4. In contrast, as shown in FIG. 15(*b*), upon the falling of the ac-conversion signal FR, an upward waveform distortion occurs in Y2 line due to a transient response, since the majority of the signal electrodes except X2 and so on are subjected to a switchover from voltage V4 to voltage V2.

When waveform distortions on the scanning electrode side are reviewed by applying this model to FIGS. 14(*a*) through 14(*g*), waveforms as shown in FIGS. 16(*a*) through 16(*g*) are obtained. In other words, due to voltage inversions of the background portion such as X2, waveform distortions having directions as shown in FIG. 16(*e*) occur in the scanning electrodes of Y2 line.

A voltage having a waveform shown in FIG. 16(*f*) is applied to pixel A. A voltage having a waveform shown in FIG. 16(*g*) is applied to pixel B. As clearly shown by FIGS. 16(*f*) and 16(*g*), the effective value of the voltage to be applied to pixel A decreases, while the effective value of the voltage to be applied to pixel B increases. As a result, pixel B becomes brighter than pixel A, thereby causing crosstalk of A type. Additionally, FIG. 16(*a*) shows a waveform of the scanning clock LP, and FIG. 16(*b*) shows a waveform of the ac-conversion signal FR.

Next, an explanation will be given on the cause of the crosstalk of B type.

FIGS. 17(*c*) and 17(*d*) respectively show optimal binary-voltage waveforms that are applied to signal electrodes X2 and X6, and there is no difference recognized between signal electrode X2 and signal electrode X6 even when their effective values are compared. In an actual liquid crystal display, however, dull waveforms as shown in FIGS. 17(*e*) and 17(*f*) are applied due to internal resistance of the signal-side driving circuit 102 and resistive components of the signal electrodes inside the liquid crystal panel. Additionally, in FIGS. 17(*e*) and 17(*f*), these dull portions are indicated by straight lines in a simplified form for convenience of explanation; however, in an actual operation, they vary in response to charging and discharging waveforms applied to the capacity.

Therefore, as clearly shown by FIGS. 17(*e*) and 17(*f*), in signal electrode X6 which is subjected to more number of changes in the binary-voltage waveform to be applied to the signal electrode due to the stripe-shaped displays, the dull portions appear more often than those in signal electrode X2, and the effective value drops by the corresponding degree. For this reason, a pixel on signal electrode X6 (for example, pixel C) becomes darker than a pixel on signal electrode X2 (for example, pixel A), thereby causing crosstalk of B type.

In order to solve the above-mentioned problems, it has been proposed to reduce crosstalk of A type by applying a compensating voltage whose polarity is inverted to that of the distortion occurring in the scanning electrode (which is referred to as the first prior art described in, for example, Japanese Laid-Open Patent Publication No. 171718/1990 (Tokukaihei 2-171718), Japanese Laid-Open Patent Publication No. 348385/1992 (Tokukaihei 4-348385), Japanese Laid-Open Patent Publication No. 12030/1994 (Tokukaihei 6-12030), etc.)

Moreover, it has also been proposed to reduce crosstalk of B type by providing an inversion period which corresponds to a certain period in the driving period of one scanning line (which is referred to as the second prior art described in, for example, Japanese Laid-Open Patent Publication No. 333315/1993 (Tokukaihei 5-333315), Japanese Laid-Open Patent Publication No. 276794/1992 (Tokukaihei 4-276794), Japanese Laid-Open Patent Publication No. 130797/1991 (Tokukaihei 3-130797) (U.S. Pat. No. 5,400,049), etc.)

However, the above-mentioned first and second prior arts have the following problems.

In the first prior art, although there is a certain degree of reducing effect on the distortion occurring in the scanning electrodes, it is not possible to reduce crosstalk of B type caused by the distortion occurring in the signal electrodes and frequency characteristics.

In this case, it is necessary to provide a detection circuit for detecting distortion on the scanning side and a compensation circuit for compensating for the distortion. However, in an actual operation, time lag always occurs between the detection circuit and the compensation circuit, and it is therefore inevitable to have a certain degree of distortion in the scanning electrodes which is left at its rising portion. As a result, distorted waveforms, which still remain in spite of the compensation, are applied to the liquid crystal panel irregularly with low frequencies depending on display patterns.

In the case of large-size liquid crystal panels which are driven by using high duty ratios and liquid crystal panels which use liquid crystal materials of low-threshold-value voltage in order to achieve low costs, or in the case where liquid crystal panels are operated at high temperature, their frequency characteristics tend to deteriorate and variations in transmittance with respect to the frequency become greater. In such cases, the above-mentioned distorted waveforms, which still remain slightly, vary with low frequencies that are irregular and highly discernible by the eye; this causes problems such as flickers and conspicuous beats.

The second prior art makes it possible to equalize dull waveforms on the scanning electrode side to a certain degree and to reduce crosstalk of B type. However, since it needs to increase the number of inversions in voltage waveforms to be applied to the signal electrodes, crosstalk of A type is, on the contrary, increased by the corresponding degree.

SUMMARY OF THE INVENTION

It is an objective of the present invention to provide a liquid crystal display which is capable of reducing two different types of crosstalk at the same time and displaying images in high quality.

In order to achieve the above-mentioned objective, the liquid crystal display of the present invention is provided with: a liquid crystal panel having a plurality of signal electrodes and a plurality of scanning electrodes that are disposed in an intersecting manner with a liquid crystal layer located in between, a signal-side driving means for applying voltages representative of data to be displayed on the liquid crystal panel to the signal electrodes, a scanning-side driving means for successively applying scanning voltages to the scanning electrodes, a control means for controlling the signal-side driving means so that rounded waveforms of voltages, which are to be respectively applied to the signal electrodes, are made virtually constant, and a distortion-eliminating means for eliminating voltage distortions that occur in non-selected scanning electrodes, when the signal-side driving means is controlled by the control means.

With this arrangement, the signal-side driving means is controlled by the control means so that rounded waveforms of voltages to be respectively applied to the signal electrodes are made virtually constant. At this time, voltage distortions occur in the non-selected scanning electrodes due to variations in voltage level in the signal electrodes that are resulted from this controlling operation. However, these voltage distortions are eliminated by the distortion-eliminating means.

As a result, rounded waveforms of voltages to be applied to the signal electrodes are made virtually constant, and voltage distortions caused in the non-selected scanning electrodes are eliminated; thus, it becomes possible to positively reduce the two types of crosstalk. In addition, it is possible to make less conspicuous flickers and beats due to irregularly distorted waveforms which still remain slightly.

The control means is preferably designed so that it controls the signal-side driving means so as to have at least one voltage-level change during a driving period for one scanning line.

With this arrangement, the voltage level to be applied to the signal electrodes is allowed to change at least once during the driving period for one scanning line, independent of display data. Therefore, the effective values of waveforms of voltages to be applied to the signal electrodes become virtually equal independent of the display data.

Moreover, the level of the voltage to be applied to the signal electrodes has at least one change during the driving period for one scanning line, and the waveform distortion in the scanning electrodes due to this change in the voltage level is eliminated by the distortion-eliminating means. Therefore, even if any waveform distortion still remains in the scanning electrodes, the waveform distortion is periodically applied to each scanning line, and is applied to the liquid crystal panel with relatively high frequencies. As a result, flickers become less conspicuous even in the case of using a liquid crystal panel wherein the variation in threshold voltage is comparatively large with respect to frequency.

Furthermore, the control means is preferably designed so as to release a control signal which sets a predetermined period from the start of the driving period for one scanning line as the second driving period, as well as setting the rest of the driving period as the first driving period, and which distinguishes the first and second driving periods. The signal-side driving means is preferably provided with an output control means which, during the first driving period, outputs a voltage having a level corresponding to the display data in a scanning line currently being scanned, in accordance with the control signal, and w hich, during the second driving period, outputs a voltage having a level different from the level corresponding to the display data one scanning line before the line currently being scanned.

With this arrangement, the voltage level to be applied to the signal electrodes positively changes at least once during the driving period for one scanning line.

Furthermore, the distortion-eliminating means is preferably provided with a current detection means for detecting a current flowing through a line of the scanning-side driving means to which the non-selected voltage is applied, a compensating-voltage generation circuit for generating a compensating voltage for compensating the voltage distortion in accordance with the detected current, and an addition circuit for adding the compensating voltage to the non-selected voltage that is applied to the scanning-side driving means.

With this arrangement, the compensating voltage is generated in accordance with the current flowing through the line of the scanning-side driving means to which the non-selected voltage is applied; therefore, it is allowed to vary in accordance with the size of the voltage distortion caused in the line. Then, the compensating voltage is added to the non-selected voltage of the scanning-side driving means by the addition circuit. As a result of this addition, the voltage distortion, which is caused in the non-selected scanning electrodes, is cancelled by the compensating voltage that varies in accordance with the size thereof, and is positively eliminated.

Moreover, in another embodiment, the distortion-eliminating means is preferably provided with: the first current detection means for detecting a current flowing through the first line of the signal-side driving means to which an on-voltage is applied, the second current detection means for detecting a current flowing through the second line of the signal-side driving means to which an off-voltage is applied, the first compensating-voltage generation circuit for generating the first compensating voltage for compensating for the voltage distortion in accordance with the current detected by the first current detection means, the second compensating-voltage generation circuit for generating the second compensating voltage for compensating for the voltage distortion in accordance with the current detected by the second current detection means, and an addition circuit for adding the first compensating voltage and the second compensating voltage and for outputting the resulting voltage to a line of the scanning-side driving means to which the non-selected voltage is applied.

With this arrangement, the first compensating voltage, which is formed based on the current flowing through the first line, and the second compensating voltage, which is formed based on the current flowing through the second line, are added, and the resulting voltage is outputted to the line with a polarity inverted to that of the voltage distortion that is caused in the non-selected scanning electrodes. This makes it possible to positively eliminate the voltage distortion that is caused in the non-selected scanning electrodes.

Further, the above-mentioned distortion-eliminating means can be achieved by applying a noise eliminating means which has been widely used.

For a fuller understanding of the nature and advantages of the invention, reference should be made to the ensuing detailed description taken in conjunction with the accompanying drawings.

BRIEF DESCRIPTION OF THE DRAWINGS

FIGS. 6(*a*) through 6(*g*) are timing charts which show operations of the compensation circuit of FIG. 5.

FIGS. 8(*a*) through 8(*i*) are timing charts which show operations wherein rounded waveforms occurring in respective electrodes are actually taken into consideration in FIGS. 7(*a*) through 7(*i*).

FIGS. 15(*a*) and 15(*b*) are schematic illustrations which show causes of crosstalk of A type in the conventional liquid crystal display.

DESCRIPTION OF THE EMBODIMENTS

Figures 10A, 10B, 10C, 10D:
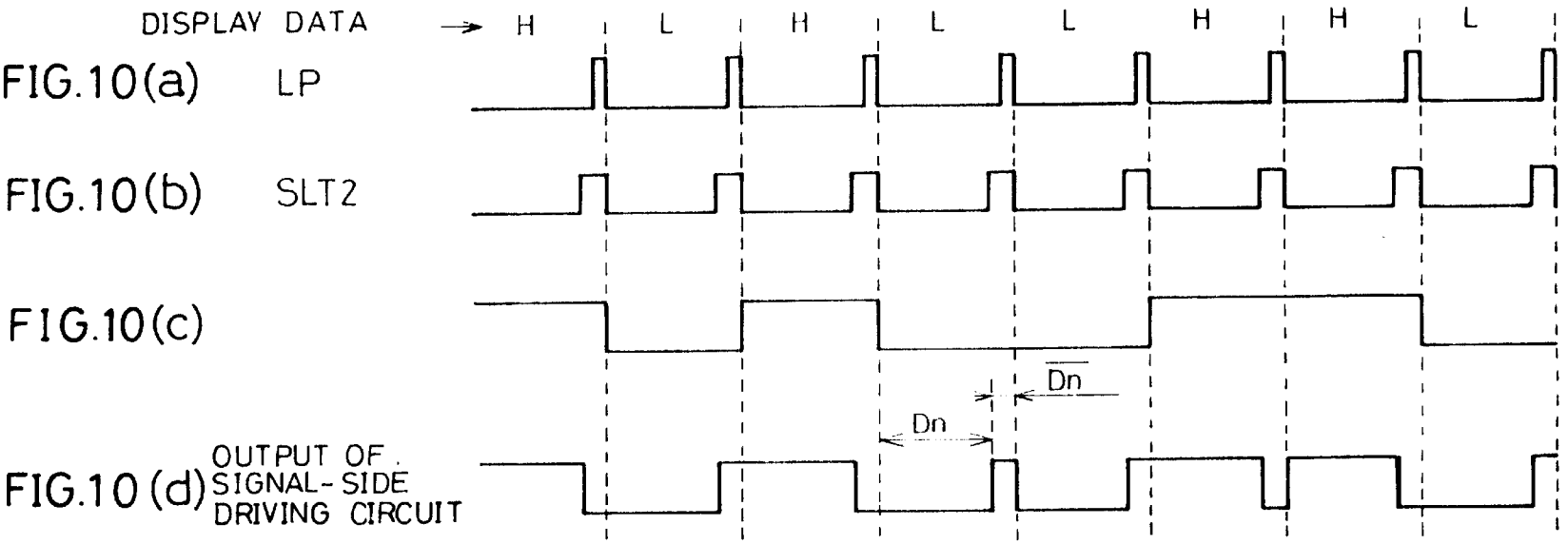
FIGS. 10(*a*) through 10(*d*) are timing charts which show an operational example of the signal-side driving circuit of FIG. 9.
Figure 11:
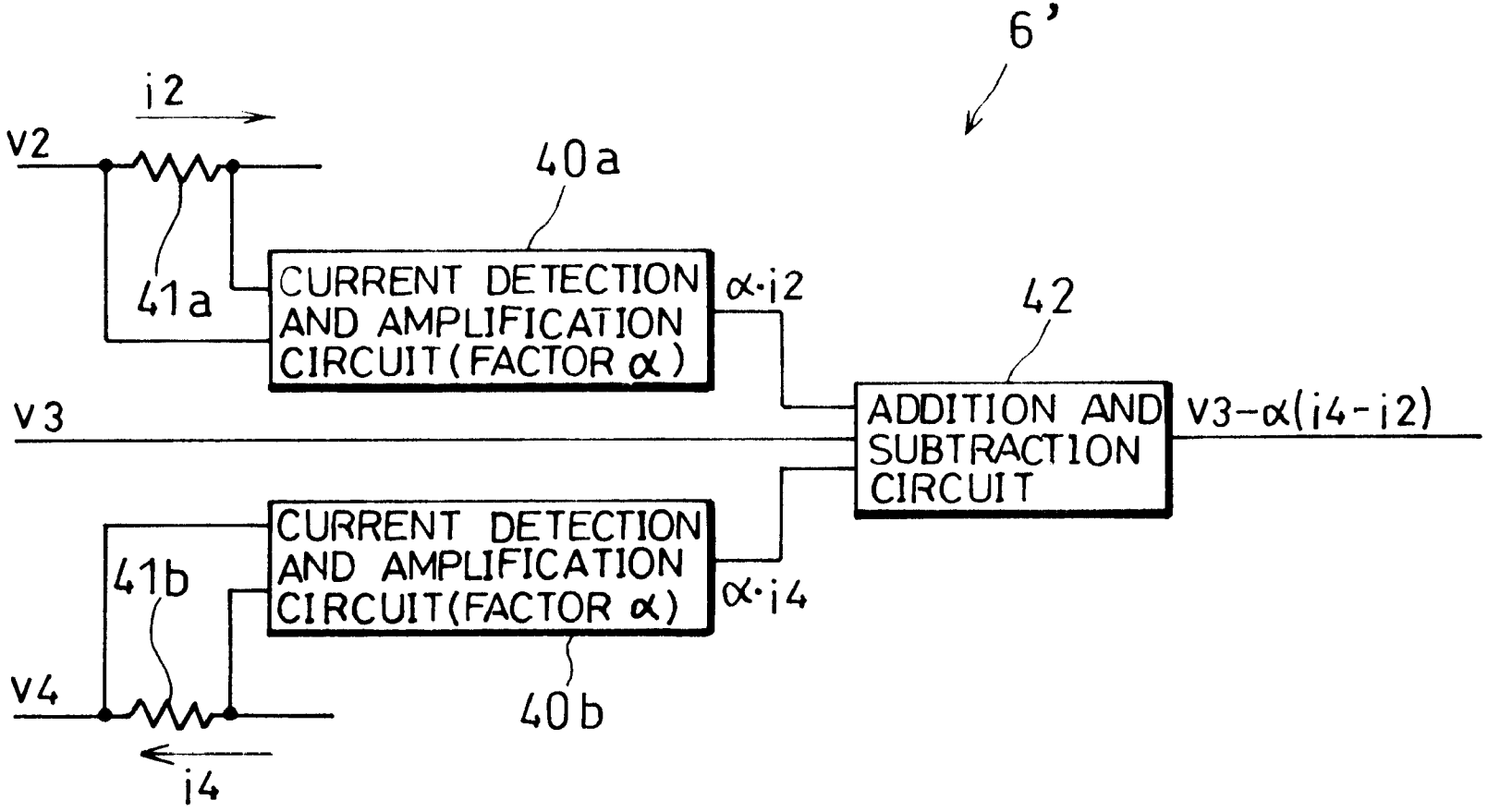
FIG. 11 is a block diagram showing an arrangement of another compensation circuit of one embodiment of the present invention.
Figure 12:
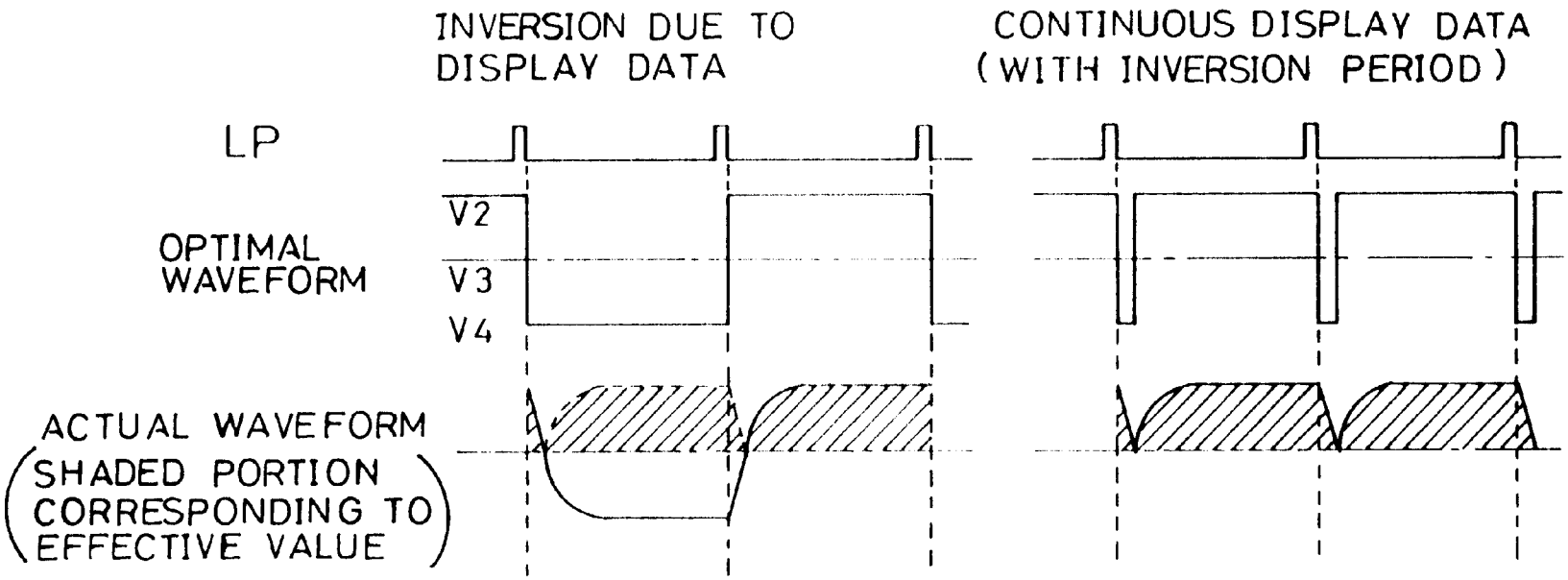
FIGS. 12(*a*) and 12(*b*) are waveform drawings which indicate improvements in crosstalk of B type that have been achieved by one embodiment of the present invention.
Figure 13:
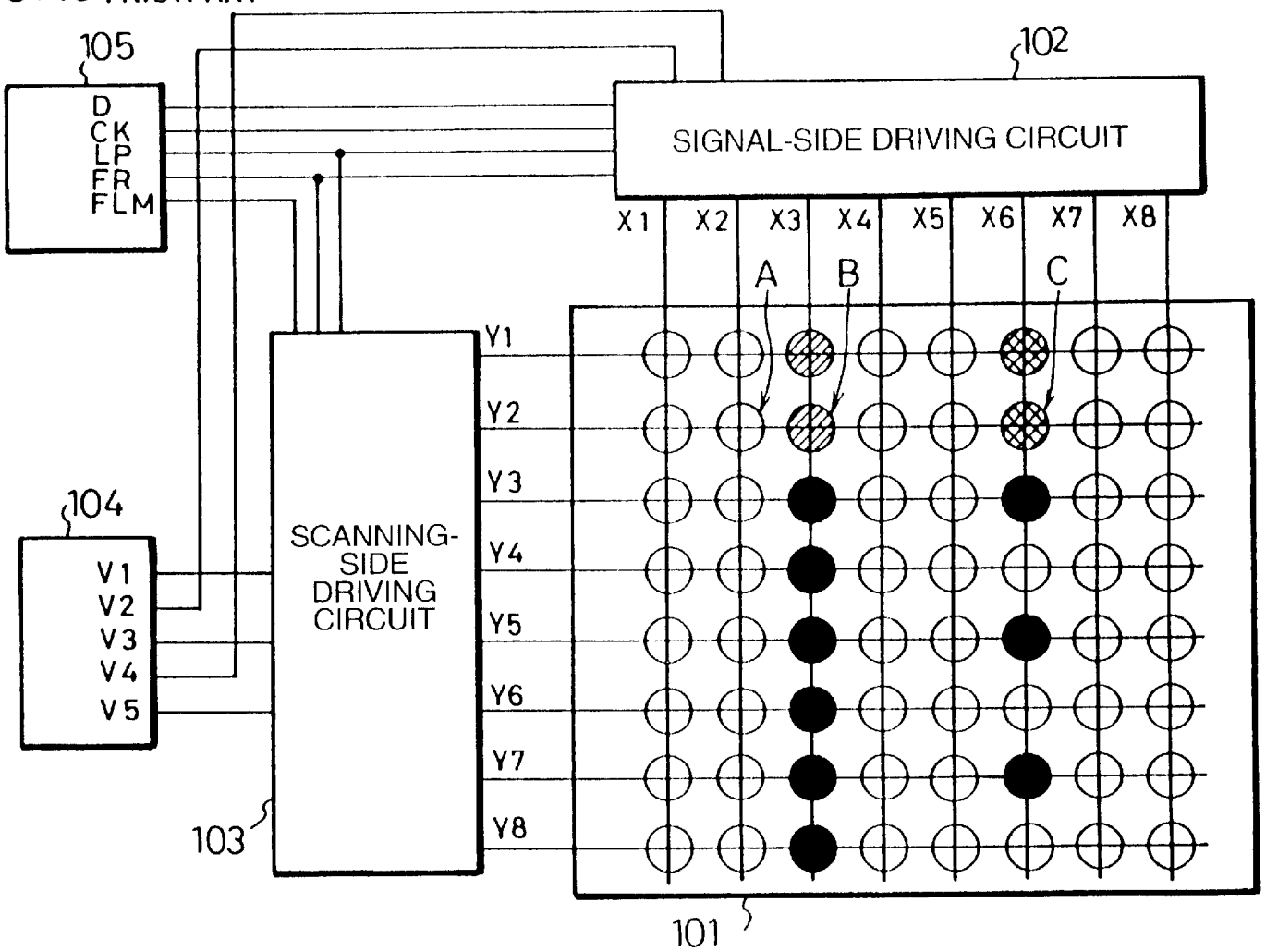
FIG. 13 PRIOR ART
FIG. 13 is a block diagram showing an arrangement of a conventional liquid crystal display.
Figures 14A, 14B, 14C, 14D, 14E, 14F, 14G:
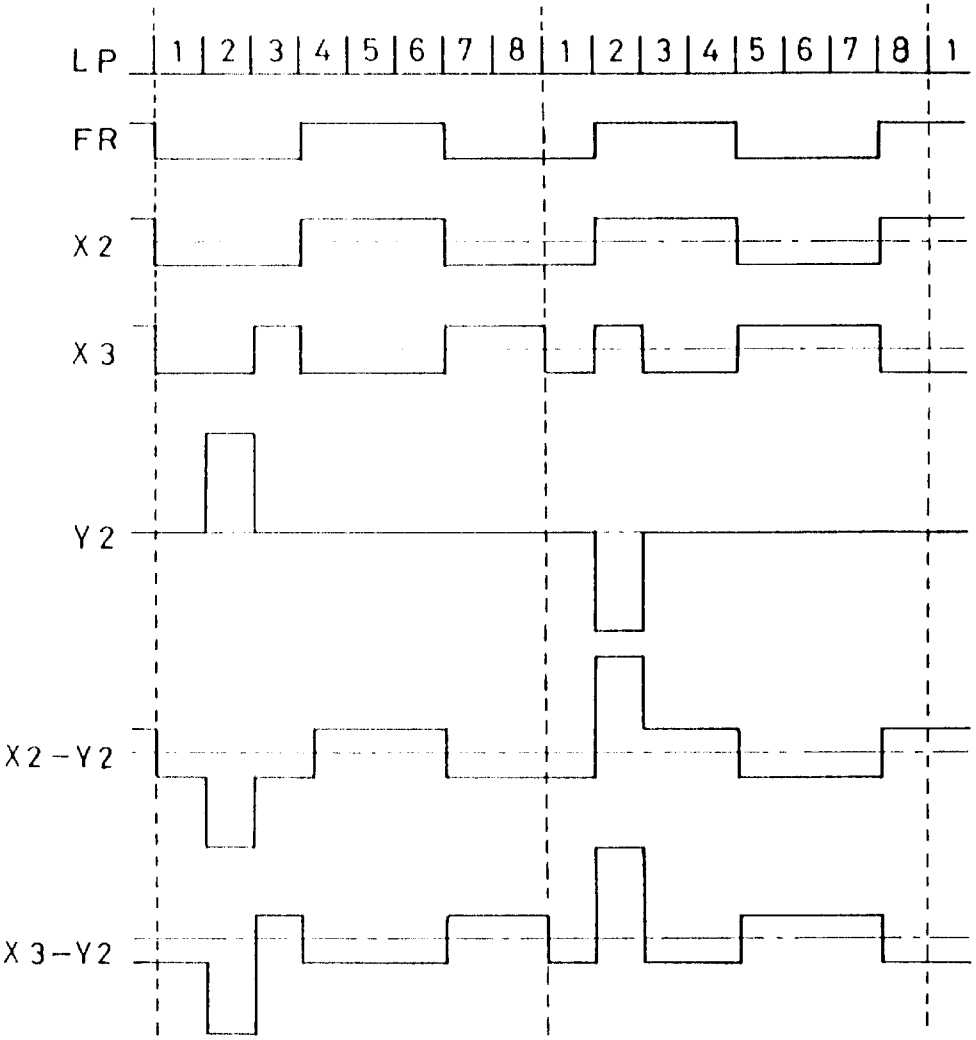
FIG.14(a) PRIOR ART
FIG.14(b) PRIOR ART
FIG.14(c) PRIOR ART
FIG.14(d) PRIOR ART
FIG.14(e) PRIOR ART
FIG.14(f) PRIOR ART
FIG.14(g) PRIOR ART
FIGS. 14(*a*) through 14(*g*) are timing charts which show optimal operations in the liquid crystal display of FIG. 13.
Figures 16A, 16B, 16C, 16D, 16E, 16F, 16G:
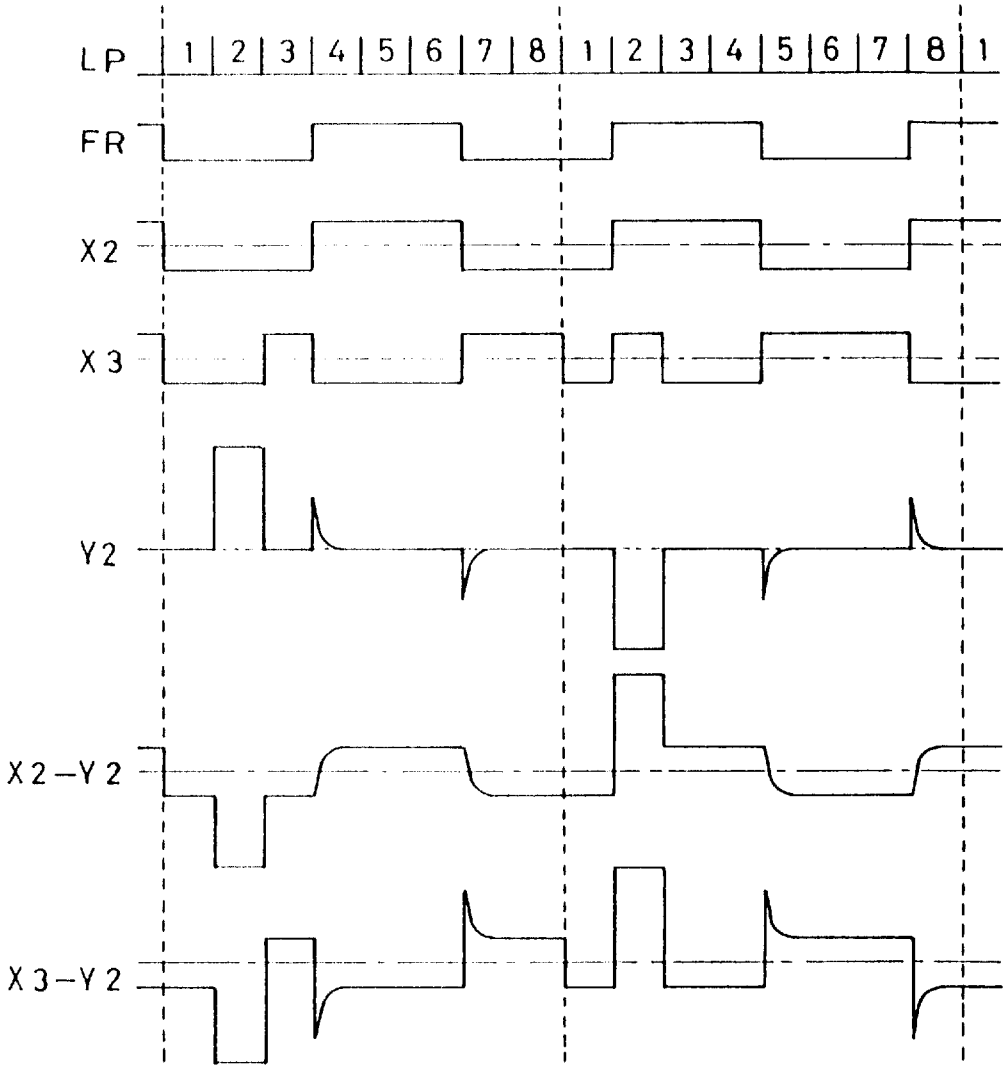
FIG.16(a) PRIOR ART
FIG.16(b) PRIOR ART
FIG.16(c) PRIOR ART
FIG.16(d) PRIOR ART
FIG.16(e) PRIOR ART
FIG.16(f) PRIOR ART
FIG.16(g) PRIOR ART
FIGS. 16(*a*) through 16(*g*) are timing charts showing actual operations in the conventional liquid crystal display.
Figures 17A, 17B, 17C, 17D, 17E, 17F:
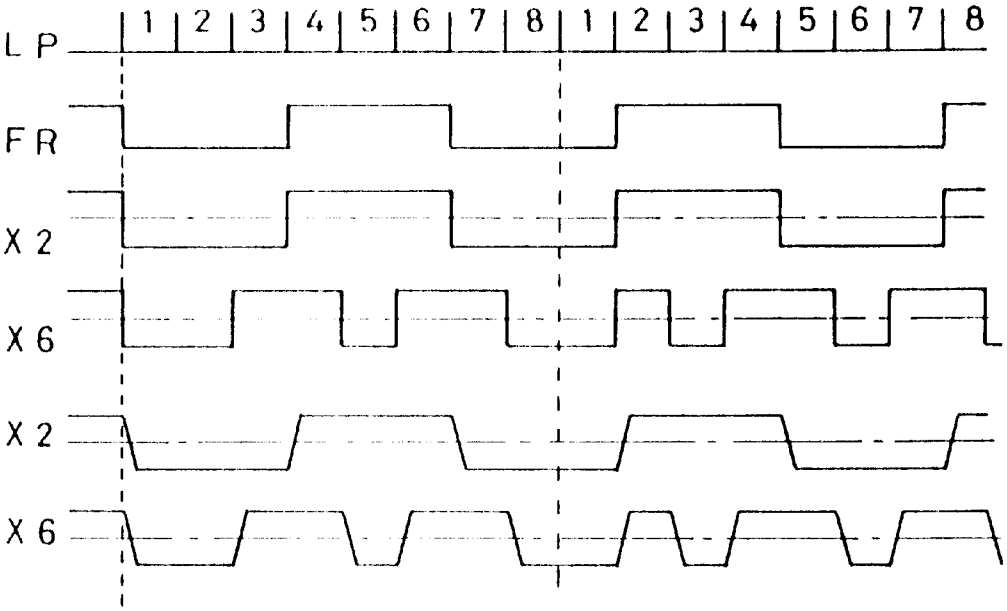
FIG.17(a) PRIOR ART
FIG.17(b) PRIOR ART
FIG.17(c) PRIOR ART
FIG.17(d) PRIOR ART
FIG.17(e) PRIOR ART
FIG.17(f) PRIOR ART
FIGS. 17(*a*) through 17(*f*) are timing charts which show causes of crosstalk of B type in the conventional liquid crystal display.

Referring to FIGS. 1 through 11 as well as FIGS. 12(*a*) and 12(*b*), the following description will discuss one embodiment of the present invention.

Figure 1:
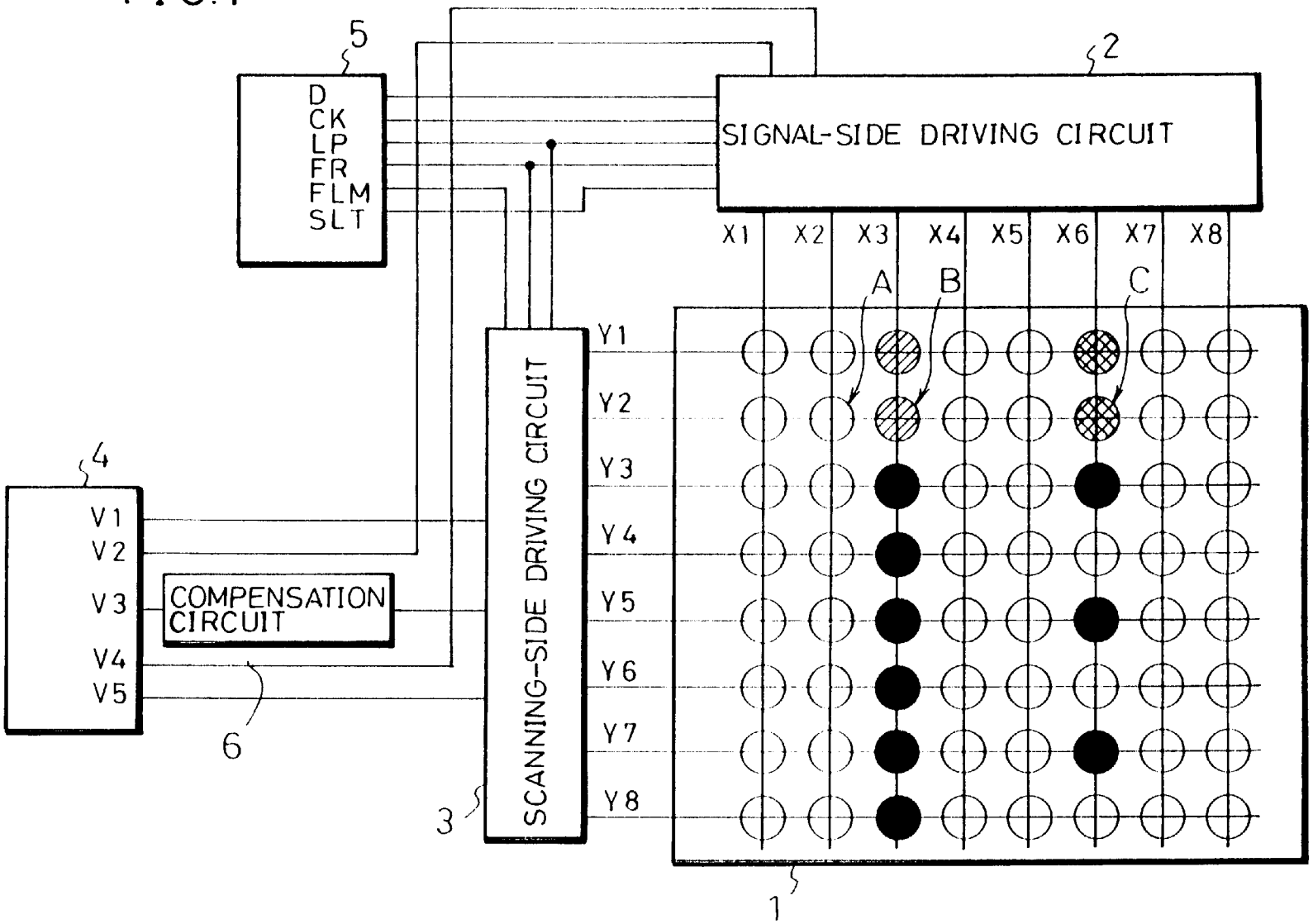
FIG. 1 is a block diagram showing a structural example of a liquid crystal display in one embodiment of the present invention.

As illustrated in FIG. 1, a liquid crystal display of the present embodiment is provided with: a liquid crystal panel 1 having a plurality of scanning electrodes Y1 through Y8 and a plurality of signal electrodes X1 through X8 which are arranged in a manner orthogonally intersecting one another and a liquid crystal layer (not shown) placed between those electrodes of two types; a scanning-side driving circuit 3 (scanning-side driving means) for successively applying scanning voltages to the scanning electrodes Y1 through Y8; a signal-side driving circuit 2 (signal-side driving means) for applying binary voltages representative of display data to the signal electrodes X1 through X8; and a power-source circuit 4 for generating voltages (V1 through V5) required for the driving operation. The liquid crystal display is also provided with a control circuit 5 (control means) for controlling the scanning-side driving circuit 3 and the signal-side driving circuit 2 and a compensation circuit 6 (distortion-eliminating means) for detecting waveform distortions occurring in V3 which is a non-selected voltage on the scanning side and for compensating for the distortions.

Here, for convenience of explanation, it is assumed in the following explanation that eight scanning electrodes and eight signal electrodes are respectively provided, that these electrodes are driven by one eighth duty, and that the signal-reversing cycle for ac drive is three scanning lines. However, the present invention is not intended to be limited to this arrangement.

The basic driving method of this liquid crystal display is the same as the conventional driving method: The scanning electrodes Y1 through Y8 are successively scanned in accordance with an inputted scanning clock LP and scanning start signal FLM, and when selected, they are subjected to selected voltages applied from the power source circuit 4 through the scanning-side driving circuit 3, and when not selected, they are subjected to non-selected voltages which are supplied by the compensation circuit 6 after having been subjected to its compensating operation. The signal electrodes X1 through X8 are, on the other hand, subjected to an on-voltage or an off-voltage that is supplied from the signal-side driving circuit 2 in accordance with display data.

In the signal-side driving circuit 2, when the same display data continue for two scanning lines or more (that is, when display data of V2 level continue or when display data of V4 level continue), the display data is inverted for a predetermined period (that is, V2 level is changed to V4 level, or V4 level is changed to V2 level). With this arrangement, the binary voltage to be applied to the signal electrodes has a change in its state at least once in each driving period for one scanning line; therefore, the effective value and frequency component of the binary voltage become virtually constant, independent of display patterns. Thus, the rounded waveform of the binary voltage is made constant.

Figure 2:
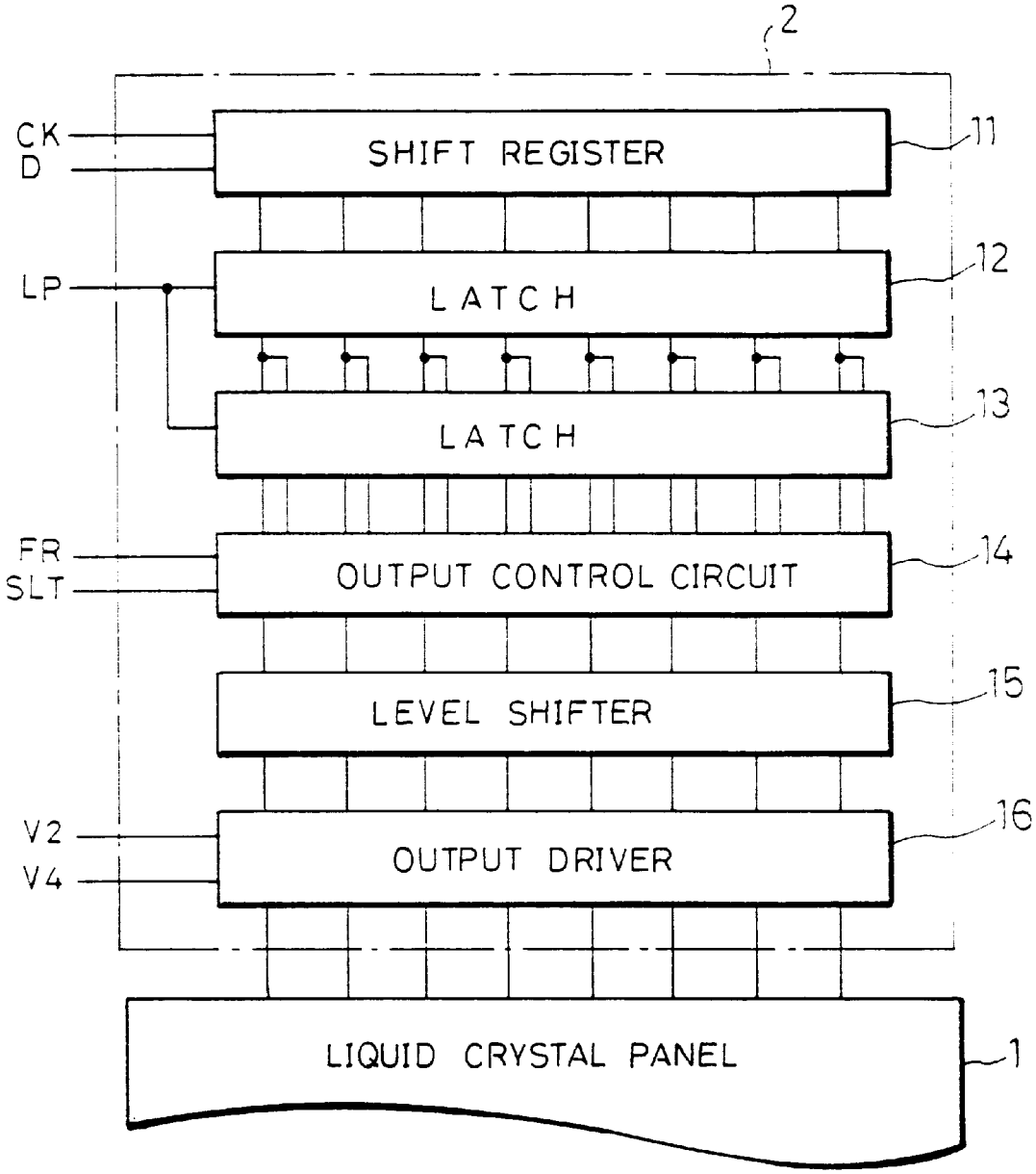
FIG. 2 is a block diagram showing the internal arrangement of a signal-side driving circuit shown in FIG. 1.

For example, as shown in FIG. 2, the signal-side driving circuit 2 is mainly constituted of: a shift register 11 for transferring display data D by using a data shift clock CK, a latch (first latch) 12 which, upon completion of transferring display data corresponding to one scanning line, holds data for the scanning line in question in accordance with an LP signal, a latch (second latch) 13 which holds data for one scanning line before the present scanning line in accordance with the same LP signal, an output control circuit 14 for determining which output is made, the output of the latch 12 or the output of the latch 13, in accordance with an ac-conversion signal FR and an inversion-period setting signal SLT, a level shifter 15, and an output driver 16 for outputting to the signal electrodes voltage V2 or voltage V4 in accordance with a signal from the output-control circuit 14.

The inversion-period setting signal SLT is used for setting a period during which the output of the signal-side driving circuit 2 is inverted. In the present embodiment, the inversion-period setting signal SLT, which is generated by the control circuit 5, is set to rise simultaneously as the start of a driving period for one scanning line, keep H (High level) for a predetermined period, and then become L (Low level) to remain L until the start of driving period for the next scanning line.

Figure 3:
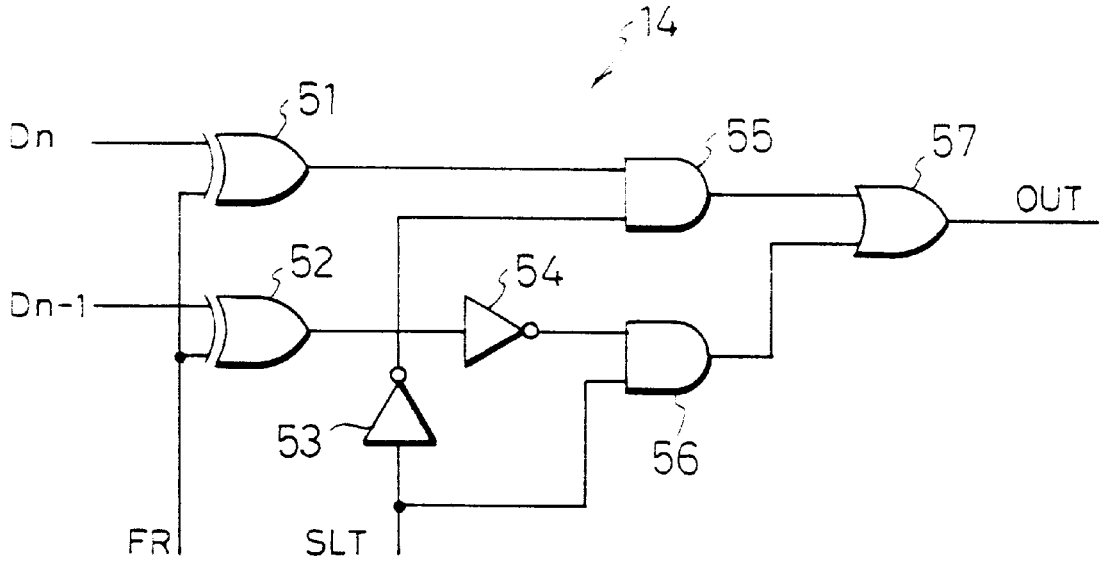
FIG. 3 is a circuit diagram showing one example in which the output control circuit of FIG. 2 is constituted by logical circuits.

The output control circuit 14 can be readily achieved by using logical circuits. For example, as shown in FIG. 3, the output control circuit 14 is mainly constituted of: an exclusive-OR circuit 51 for conducting an exclusive-OR operation on display data Dn in a scanning line and the ac-conversion signal FR; an exclusive-OR circuit 52 for conducting an exclusive-OR operation on display data Dn-1, which is the display data one line before Dn, and the ac-conversion signal FR; an inverter circuit 53 for inverting the inversion-period setting signal SLT for setting a period during which the binary voltage is inverted; an inverter circuit 54 for inverting the output of the exclusive-OR circuit 52; an AND circuit 55 for conducting an AND operation on the output of the exclusive-OR circuit 51 and the output of the inverter circuit 53; an AND circuit 56 for conducting an AND operation on the output of the inverter circuit 54 and the inversion-period setting signal SLT; and an OR circuit 57 for conducting an OR operation on the output of the AND circuit 55 and the output of the AND circuit 56.

The output control circuit 14 carries out operations based on a truth table shown in Table 1.

TABLE 1

| FR | Dn - 1 | Dn | SLT | OUT | OUTPUT VOL. |
|---|---|---|---|---|---|
| H | L | L | L | L | V4 |
| | | | H | H | V2 |
| | H | L | L | L | V4 |
| | | | H | L | V4 |
| | L | H | L | H | V2 |
| | | | H | H | V2 |
| | H | H | L | H | V2 |
| | | | H | L | V4 |
| L | L | L | L | L | V2 |
| | | | H | H | V4 |
| | H | L | L | L | V2 |
| | | | H | L | V2 |
| | L | H | L | H | V4 |
| | | | H | H | V4 |
| | H | H | L | H | V4 |
| | | | H | L | V2 |

Figure 4:
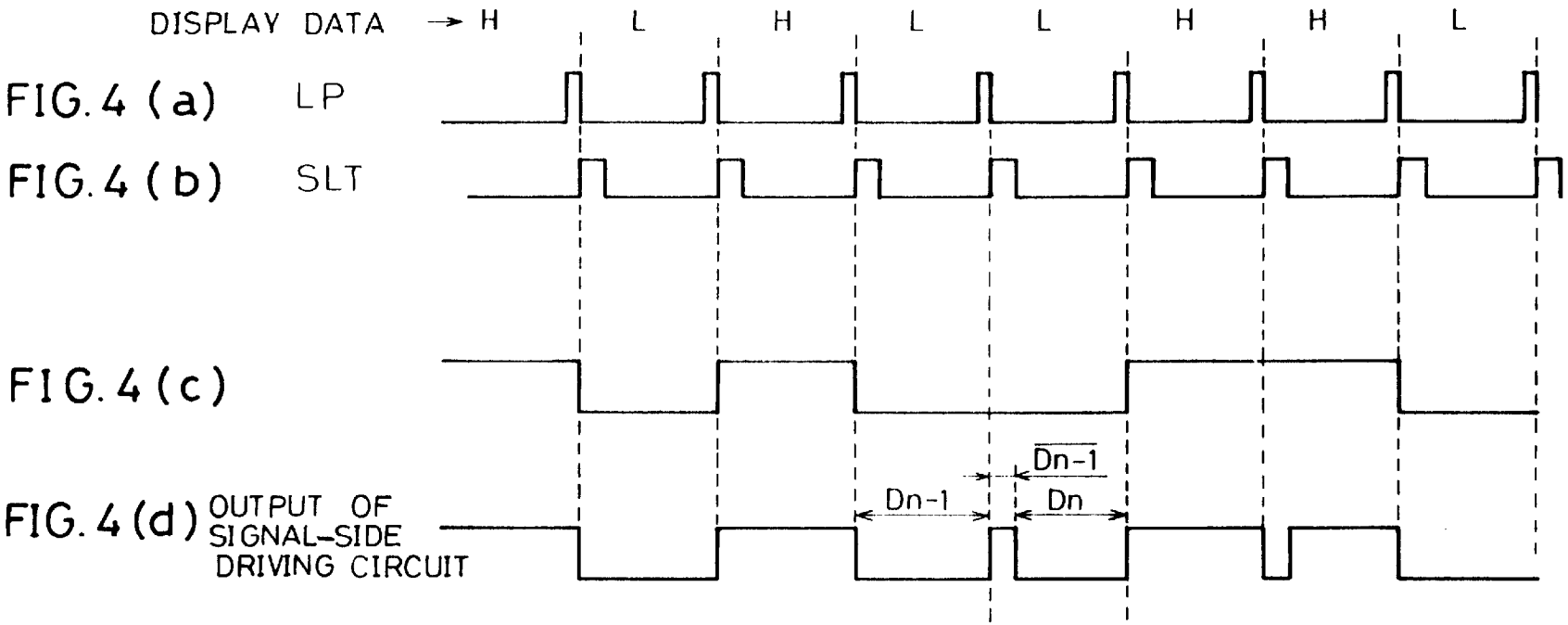
FIGS. 4(*a*) through 4(*d*) are timing charts which show an operational example of the signal-side driving circuit of FIG. 2.

Referring to FIGS. 4(*a*) through 4(*d*), the following description will discuss the operations of the circuits shown in FIG. 2.

The output control circuit 14, to which the inversion-period setting signal SLT has been inputted, outputs display data Dn for a scanning line in question during a period of L (Low Level) of the inversion-period setting signal SLT, while it outputs data obtained by inverting display data Dn-1 that is the display data one line before Dn, during a period of H (High Level) of the inversion-period setting signal SLT.

In other words, as shown in FIG. 4(*d*), the output of the signal-side driving circuit 2 is inverted only during the period of H (High Level) of the inversion-period setting signal SLT upon receipt of a portion consisting of continuous display data of the same level for two scanning lines or more. In the case of no change in display data also, the output is inverted, and the output waveform becomes rounded. Since the pulse width (the period of High Level) of the inversion-period setting signal SLT is adjusted so that the roundness of the output waveform in the case of no change in display data becomes virtually the same as the roundness of the output waveform in the case of a change in display data, the frequency component and effective value of the voltage waveform to be applied to the signal electrodes become virtually constant independent of display data. As a result, it is possible to positively reduce crosstalk of the aforementioned B type.

Here, FIG. 4(*a*) shows a waveform of the scanning clock LP, FIG. 4(*b*) shows a waveform of the inversion-period setting signal SLT, and FIG. 4(*c*) shows an output waveform of the signal-side driving circuit 2 in the case where the inversion period is not provided.

When the output inversion period of the signal-side driving circuit 2 is provided as described above, a waveform distortion is induced in the scanning electrodes upon inversion in the case of a display pattern having many of the signal electrodes inverted in the same direction (see FIG. 6(*d*)). The present embodiment is, however, provided with the compensation circuit 6 (see FIG. 1) for detecting and eliminating the waveform distortion, in order to solve the above-mentioned problem.

Figure 5:
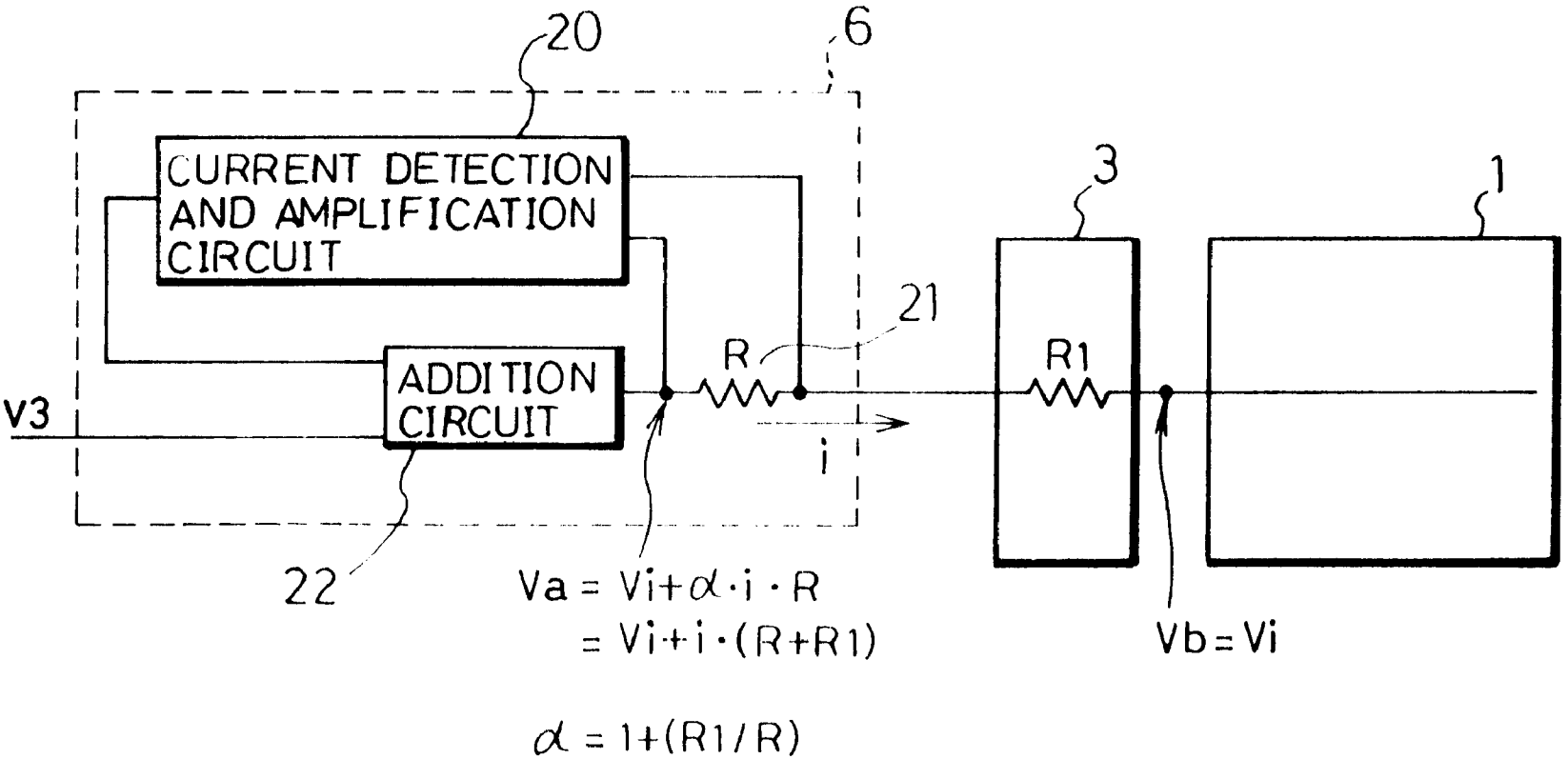
FIG. 5 is an explanatory drawing which illustrates a compensation circuit shown in FIG. 1.

For example, as shown in FIG. 5, the compensation circuit 6 is mainly constituted of: a current detection and amplification circuit 20, a resistor 21 for current-detection use which is inserted in the line of non-selected voltage V3 to be applied to the scanning electrodes, and an addition circuit 22 for adding the output of the current detection and amplification circuit 20 and non-selected voltage V3. In this case, the current detection and amplification circuit 20, the addition circuit 22 and other circuits can be readily arranged at low costs by using general-purpose operational amplifiers and other devices.

The current detection and amplification circuit 20 detects a current i (see FIG. 6(*e*)) flowing through the line to which non-selected voltage V3 is applied, based on a voltage across the resistor 21 for current-detection use, amplifies the voltage the resistor 21 for current-detection use by a predetermined amplification factor of $\alpha$, and outputs an amplified voltage as a compensating voltage to the addition circuit 22. When this compensating voltage (having a waveform shown in FIG. 6(*f*) due to a delay caused by loop in the compensation circuit 6) and the waveform distortion in the scanning electrodes (see FIG. 6(*d*)) are added to each other by the addition circuit 22 so as to make a compensation, the waveform of the non-selected voltage, which has been subjected to the compensation and is applied to the scanning electrodes, only has an extremely thin distortion like a protrusion, as shown in FIG. 6(*g*). Thus, it become possible to reduce crosstalk of the aforementioned A type to a great degree.

Supposing that the equivalent resistance of the scanning-side driving circuit 3 is R1, that the output of the addition circuit 22 is Va, and that the input voltage of the liquid crystal panel 1 is Vi, the amplification factor $\alpha$ of the current detection and amplification circuit 20 is represented by $\alpha=1+(R1/R)$, because $Va=Vi+\alpha.i.R=Vi+i(R+R1)$ holds.

Here, FIG. 6(*a*) shows a waveform of the scanning clock LP, FIG. 6(*b*) shows a waveform of the inversion-period setting signal SLT, and FIG. 6(*c*) shows an output waveform of the signal-side driving circuit 2.

Figures 7A, 7B, 7C, 7D, 7E, 7F, 7G, 7H, 7I:
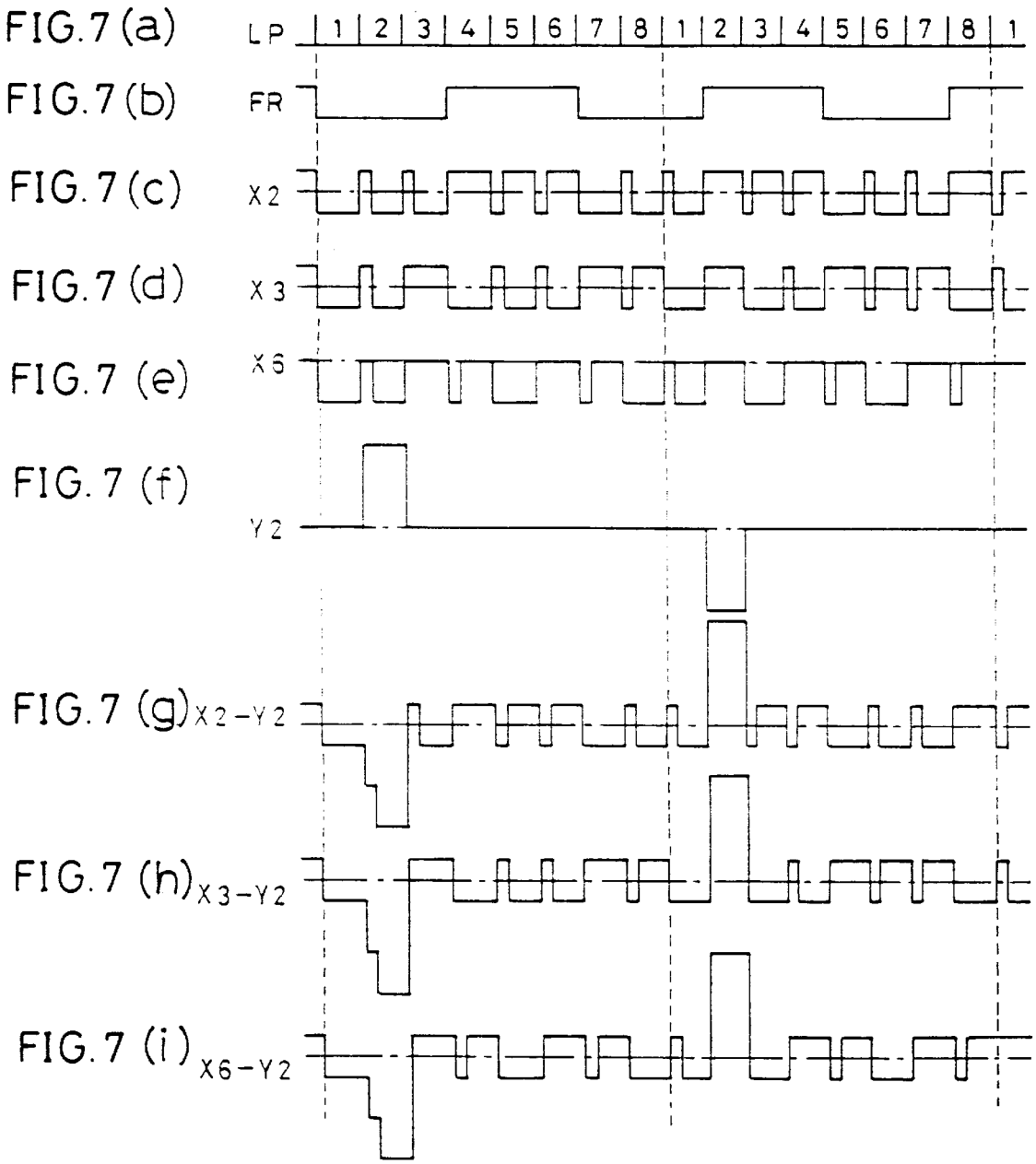
FIGS. 7(*a*) through 7(*i*) are timing charts which show optimal operations of the liquid crystal display in the arrangement of FIG. 1.

In the arrangement of FIG. 1, waveforms in the respective parts, shown in FIGS. 7(*a*) through 7(*i*), are obtained in the case where no consideration is given to the roundness of each waveform. In other words, during the period of L (Low Level) of the inversion-period setting signal SLT which is synchronous to a fall of the scanning clock LP (see FIG. 7(*a*)), display data for a scanning line in question is outputted as it is. On the other hand, during the period of H (High Level) of the inversion-period setting signal SLT, data obtained by inverting display data that is the display data one line before the display data for the scanning line in question.

As a result, voltage waveforms to be applied to signal electrodes X2, X3, and X6 from the signal-side driving circuit 2, which are respectively shown in FIGS. 7(*c*), 7(*d*) and 7(*e*), are inverted only during the period of H (High Level) of the inversion-period setting signal SLT, even when the same level in binary levels continue in display data. Therefore, voltages, whose waveforms are shown in FIGS. 7(*g*), 7(*h*) and 7(*i*), are respectively applied to pixel A (intersection of signal electrode X2 and scanning electrode Y2), pixel B (intersection of signal electrode X3 and scanning electrode Y2), and pixel C (intersection of signal electrode X6 and scanning electrode Y2). With this arrangement, signals having virtually the same effective value and frequency component are applied to the respective pixels independent of display patterns; this makes it possible to positively reduce crosstalk of the aforementioned B type. Here, FIG. 7(*f*) shows a voltage waveform to be applied to scanning electrode Y2.

In the waveforms of FIGS. 7(*c*) through 7(*i*), no consideration is given to the roundness of each waveform in the electrode: waveforms shown in FIGS. 8(*c*) through 8(*i*) are obtained when the roundness of each waveform in the electrode is taken into consideration. Voltage waveforms to be applied to signal electrodes X2, X3 and X6 are respectively shown in FIGS. 8(*c*), 8(*d*) and 8(*e*), and in these cases also, output inversion periods clearly appear at portions where the same binary level continues in display data. FIG. 8(*f*) shows a voltage waveform to be applied to scanning electrode Y2. Here, with the functions of the compensation circuit 6, hardly any waveform distortion appears in the waveform in spite of the fact that there is an output inversion on the signal-electrode side. Thus, it is possible to positively reduce crosstalk of the aforementioned A type.

As a result, voltages to be applied to respective pixels A, B and C of FIG. 1 are allowed to have virtually the same effective value and frequency component, as shown in FIGS. 8(*g*), 8(*h*) and 8(*i*) respectively; therefore, both the crosstalk of A type and crosstalk of B type can be reduced to a great degree, and it becomes possible to provide high-quality displays independent of display patterns, which have not been achieved by conventional arrangements.

As described above, the output control circuit 14 controls the signal-side driving circuit 2 so that, during a period in which the inversion-period setting signal, which is synchronous to the scanning clock having a cycle equal to the cycle of one scanning line and which has a variable duty ratio, is in one of the binary states, the binary voltage for the current scanning line is outputted from the signal-side driving circuit 2, and that, during a period in which the inversion-period setting signal is in the other of the binary states, a voltage obtained by inverting the binary voltage one line before the current scanning line is outputted from the signal-side driving circuit 2.

In the above-mentioned arrangement, the output control circuit 14 provides a period in the output of the signal-side driving circuit 2 corresponding to one scanning line, during which the voltage obtained by inverting the binary voltage one line before the current scanning line is outputted based on the binary states of the inversion-period setting signal. In this case, the effective value of the waveform of the binary voltage after the inversion is made virtually the same independent of display data, by varying the duty ratio of the inversion-period setting signal appropriately, and the rounded waveforms are made virtually constant.

In the above explanation, the arrangement as shown in FIG. 2 was used for exemplifying the signal-side driving circuit 2. However, the present invention is not intended to be limited to this arrangement. Any arrangement may be adopted, as long as the roundness in waveforms in the signal electrodes is basically made constant independent of display data: For example, a signal-side driving circuit 2' shown in FIG. 9 may be adopted.

The signal-side driving circuit 2' is mainly constituted of: a shift register 31 for transferring display data D by the use of data shift clock CK, a latch 32 for holding data for a scanning line in question by the use of LP signal upon completion of transferring display data corresponding to one scanning line, an output control circuit 33 for controlling the output of the latch 32 in accordance with an ac-conversion signal FR and an inversion-period setting signal SLT2, a level shifter 35, and an output driver 36 for outputting voltage V2 or voltage V4 in accordance with a signal from the output control circuit 33.

The inversion-period setting signal SLT2, which is applied to set a period during which the output of the signal-side driving circuit 2' is inverted from outside, is set to rise before the rise of the scanning clock LP and change from H (High Level) to L (Low Level) in synchronism with the fall of the scanning clock LP, as shown in FIGS. 10(*a*) and 10(*b*). Here, the period of H (High Level) of the inversion-period setting signal SLT2 is variable. Thus, it is possible to control the period of inversion.

Figure 9:
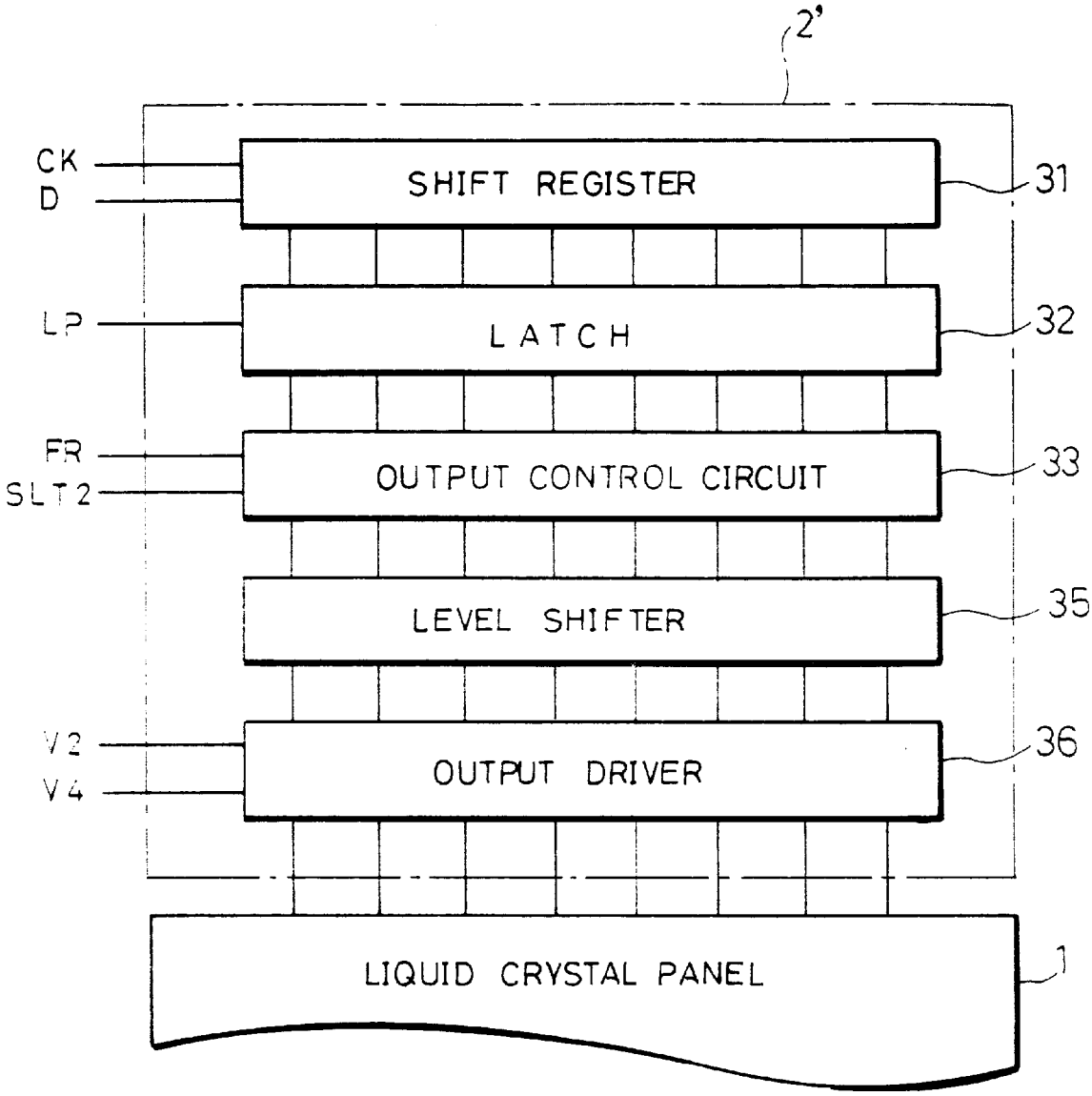
FIG. 9 is a block diagram showing the internal arrangement of another signal-side driving circuit of one embodiment of the present invention.

As clearly shown by FIG. 9, the signal-side driving circuit 21 has only one stage (latch 32) of latch for holding display data, and in this case, there is provided a period during which display data is inverted within a driving period for one scanning line.

In this case, as shown in FIGS. 10(*c*) and 10(*d*), the signal-side driving circuit 2' inverts the display data of a current scanning line (scanning line being currently driven), and outputs the resulting data only during the period of H (High Level) of the inversion-period setting signal SLT2.

Therefore, as shown in FIG. 10(*d*), the level inversion is made only during the period of H (High Level) of the inversion-period setting signal SLT2 even upon receipt of a portion consisting of continuous display data of the same level for two scanning lines. By adjusting the pulse width (the period of High Level) of the inversion-period setting signal SLT2 appropriately, it becomes possible to make virtually the same the roundness of waveform and the rounded waveform generated during the inversion period due to changes in display data. As a result, in the same manner as the signal-side driving circuit 2 of FIG. 2, it is possible to positively reduce crosstalk of the aforementioned B type, independent of display patterns.

As described above, the output control circuit 33 makes the rounded waveforms virtually the same by inverting the binary voltage for the current scanning line in accordance with the inversion-period setting signal which is synchronous to the scanning clock having a cycle equal to the cycle of one scanning line and which has a variable duty ratio.

In the above-mentioned arrangement, the output control circuit 33 inverts the binary voltage in accordance with the inversion-period setting signal for each scanning line. In this case, the effective value of the waveform of the binary voltage after the inversion is made virtually the same independent of display data, by varying the duty ratio of the inversion-period setting signal appropriately.

Moreover, the above explanation was made by exemplifying the case wherein the compensation circuit 6 detects a current flowing through the non-selected voltage line on the scanning electrode side, and superimposes its compensating voltage on the non-selected voltage so as to output the resulting voltage, in order to eliminate voltage distortion occurring in the scanning electrodes. However, the present invention is not intended to be limited to this arrangement. As shown in FIG. 11, it is possible to adopt, for example, another compensation circuit 6' which detects a current i2 and a current i4 respectively derived from on-state voltage and off-state voltage that are applied to the signal electrodes, and carries out a compensating operation with respect to the non-selected voltage applied to the scanning electrodes (that is, the compensating operation is carried out by using a noise-eliminating means which is well known in the art).

The compensation circuit 6' is mainly constituted of: current detection and amplification circuits 40*a* and 40*b* (each, having an amplification factor of $\alpha$), a resistor 41*a* for current-detection use which is inserted in the line of voltage V2, a resistor 41*b* for current-detection use which is inserted in the line of voltage V4, and an addition and subtraction circuit 42 for carrying out addition and subtraction operations between the outputs of the current detection and amplification circuits 40*a* and 40*b* and voltage V3. Here, the current detection and amplification circuits 40*a* and 40*b*, the addition and subtraction circuit 42, and other circuits can be readily arranged at low costs by using general-purpose operational amplifiers and other devices.

The current detection and amplification circuit 40*a* detects a current i2 flowing through the V2 line based on the voltage across the resistor 41*a* (the value of resistance Rd). The current detection and amplification circuit 40*b* detects a current i4 flowing through the V4 line based on the voltage across the resistor 41*b*. The currents i2 and i4 flow through the respective lines in the directions opposite to each other. The current detection and amplification circuits 40*a* and 40*b* also amplify voltages across the resistors 41*a* and 41*b* for current-detection use by the predetermined amplification factor $\alpha$, and output the results of the amplifications to the addition and subtraction circuit 42 as compensating voltages (the first and second compensating voltages). In this case, the amplification factor $\alpha$ indicates the ratio of compensating voltage with respect to the current i2 or the current i4. After a compensating operation carried out by making addition and subtraction between the two compensating voltages and voltage V3 in the addition and subtraction circuit 42, an output $[V3+\alpha(i4-i2)]$ is released from the addition and subtraction circuit 42. In other words, in the addition and subtraction circuit 42, the compensating voltage, which has a polarity reversed to that of the distortion occurring in the scanning electrodes depending on level changes in the voltage, is generated, and is added to voltage V3; this makes it possible to reduce the voltage distortion occurring in the scanning electrodes to a great degree. As a result, it becomes possible to reduce crosstalk of A type to a great degree, in the same manner as the aforementioned compensation circuit 6.

As described above, by appropriately adjusting the inversion-period of the binary voltages to be applied to the signal electrodes, the present embodiment allows the voltage waveforms to be applied to the respective signal electrodes of the liquid crystal panel to have virtually the same roundness in waveforms in all the signal electrodes, independent of the contents of data to be displayed (display patterns). This is clearly shown by the fact that the same effective value is obtained, for example, as shown by shaded portions in FIGS. 12(*a*) and 12(*b*). Therefore, all the effective values to be applied to pixels on the signal electrodes become virtually the same with virtually the same frequency component; thus, it becomes possible to reduce crosstalk of the aforementioned B type to a great degree.

Moreover, although waveform distortions occur in the non-selected voltages of the scanning electrodes due to the inversion of the output of the signal-side driving circuit 2 or 2', the waveform distortions are detected and compensated by the compensation circuit 6 or 6' so as to be eliminated. Therefore, hardly any waveform distortion appears in the non-selected voltage line of the scanning electrodes, irrespective of the contents of data to be displayed, and it is also possible to positively reduce crosstalk of the aforementioned A type to a great degree.

Furthermore, in the present embodiment, the binary voltage to be applied to the signal electrodes is allowed to have at least one inversion period during the driving period for one scanning line, and the waveform distortion in the scanning electrodes is also detected and compensated. Therefore, even if any waveform distortion still remains in the scanning electrodes, the waveform distortion is periodically applied to each scanning line, and is applied to the liquid crystal panel with relatively high frequencies. This provides an additional effect that flickers become less conspicuous even in the case of using a liquid crystal panel wherein the variation in threshold voltage is comparatively large with respect to frequency.

As described above, the present embodiment makes it possible to reduce crosstalk of both the A and B types to a great degree, makes less conspicuous flickers and beats due to irregular waveform distortions that still remain slightly, and thus remarkably improves the display quality of liquid crystal displays.

Additionally, the arrangement of the present invention is not intended to be limited to the above-mentioned embodiment: for example, the present invention is applicable to a signal-side driving circuit wherein the voltage values to be applied during the inversion period include a predetermined third voltage value in addition to the on and off voltages, as long as it intends to make the waveform distortion constant irrespective of display patterns by providing changing points in voltages in its outputs. Further, as for the circuit for eliminating the waveform distortion in the scanning electrodes, it is not limited to the above-mentioned detecting method and compensating method, and any method may be applied to the present invention as long as it conforms to the above-mentioned description.

Moreover, in the above-mentioned arrangement, externally inputted signals are used as inversion-use signals for outputs of the signal-side driving circuit; however, the present invention is not limited to this arrangement, and signals, which are generated, for example, inside the signal-side driving circuit or other circuits, may be used.

Furthermore, in the above-mentioned embodiment, the explanation was given on the driving method of the liquid crystal panel by exemplifying the case wherein, supposing that the non-selected voltage (V3) of the scanning electrodes was set to GND (ground), voltages of ± Vop (1+1/a) were applied as the selected voltages (V1, V5) and voltages of±(Vop/a) were applied to the signal side as the voltages (V2, V4) that are representative of the display data. However, the present invention is not intended to be limited to this arrangement. For example, the present invention is applicable to a case wherein: two types of voltages, Vop (1−1/a) and Vop/a, are used as the non-selected voltages of the scanning electrodes; Vop or GND is used as the corresponding selected voltage; and voltages of Vop and Vop (1−2/a) or 2Vop/a and GND are applied to the signal electrodes in accordance with the display data. Here, in this case, since there are two non-selected voltages on the scanning side, two circuits are required for eliminating distortions of the non-selected voltages on the scanning side.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display comprising:

a liquid crystal panel having a plurality of signal electrodes and a plurality of scanning electrodes that are disposed in an intersecting manner with a liquid crystal layer sandwiched in between;

signal-side driving means for applying voltages representative of data to be displayed on the liquid crystal panel to the signal electrodes;

scanning-side driving means for successively applying scanning voltages to the scanning electrodes;

control means for controlling the signal-side driving means so that the voltages, respectively applied to the signal electrodes, change at least once during a driving period for a scanning line;

distortion-eliminating means for shaping a waveform of a scanning voltage so as to eliminate a waveform distortion of the scanning voltage that is induced in non-selected scanning electrodes due to a transient response to the turning-on and turning-off of a voltage application to the signal electrodes when the signal-side driving means is controlled by the control means, whereby crosstalk of A type is compensated for; and wherein the control means adjusts the timing duration of changes in voltage applied to the signal electrodes from the beginning of the driving period for each scanning line until the time at which a voltage change occurs for the first time in each driving period so that amounts of roundness of waveforms of the voltages to be respectively applied to the signal electrodes are made virtually the same, whereby crosstalk of B type is compensated for.

2. The liquid crystal display as defined in claim 1, wherein the control means controls the signal-side driving means so that it has at least one voltage-level change during a driving period for one scanning line.

3. The liquid crystal display as defined in claim 2, wherein: the control means releases a control signal which divides the driving period for one scanning line into a first driving period and a second driving period, and the signal-side driving means includes output control means which, during the first driving period, outputs a first voltage having a level corresponding to data to be displayed on the liquid crystal panel, and which, during the second driving period, outputs a second voltage having a level different from the first level when display data of the same level continue for not less than two scanning lines.

4. The liquid crystal display as defined in claim 3, wherein: the control means sets a predetermined period from the start of the driving period for one scanning line as the second driving period as well as setting the rest of the driving period as the first driving period, and during the first driving period, the output control means outputs a voltage having a level corresponding to display data in a scanning line currently being scanned, in accordance with the control signal, and, during the second driving period, outputs a voltage having a level different from the level corresponding to display data one scanning line before the line currently being scanned.

5. The liquid crystal display as defined in claim 4, wherein: the signal-side driving means further includes a first latch for holding display data in a scanning line currently being scanned and a second latch for holding display data one scanning line before the line currently being scanned, and the output control means outputs a voltage having a level corresponding to the display data held in the first latch during the first driving period, and outputs a voltage having a level different from a level corresponding to the display data held in the second latch during the second driving period.

6. The liquid crystal display as defined in claim 3, wherein the output control means outputs the first voltage during the first driving period, and outputs the second voltage during the second driving period.

7. The liquid crystal display as defined in claim 1, wherein the distortion-eliminating means includes:

current detection means for detecting a current flowing through a line across which the non-selected voltage is applied to the scanning-side driving means;

a compensating-voltage generation circuit for generating a compensating voltage for compensating the voltage distortion in accordance with the detected current, and an addition circuit for adding the compensating voltage to the non-selected voltage that is applied to the scanning-side driving means.

8. The liquid crystal display as defined in claim 7, wherein: the current detection means includes a resistor that is inserted in the line, and the compensating-voltage generation circuit includes an amplification circuit for amplifying a voltage across the resistor.

9. The liquid crystal display as defined in claim 8, wherein, supposing that the value of resistance of the resistor is R and the equivalent resistance of the scanning-side driving means is R1, the amplification factor $\alpha$ of the amplification circuit satisfies $\alpha=1+(R1/R)$.

10. The liquid crystal display as defined in claim 1, wherein the distortion-eliminating means includes:

first current detection means for detecting a current flowing through a first line of the signal-side driving means to which an on-voltage is applied;

second current detection means for detecting a current flowing through the second line of the signal-side driving means to which an off-voltage is applied;

first compensating-voltage generation circuit for generating the first compensating voltage for compensating for the voltage distortion in accordance with the current detected by the first current detection means;

second compensating-voltage generation circuit for generating the second compensating voltage for compensating for the voltage distortion in accordance with the current detected by the second current detection means; and an addition circuit for adding the first compensating voltage and the second compensating voltage and for outputting the resulting voltage to a line of the scanning-side driving means to which the non-selected voltage is applied.

11. The liquid crystal display as defined in claim 10, wherein: the first current detection means includes a first resistor that is inserted in the first line, the second current detection means includes a second resistor that is inserted in the second line, the first compensating-voltage generation means includes a first amplification circuit for amplifying a voltage across the first resistor, and the second compensating-voltage generation means includes a second amplification circuit for amplifying a voltage across the second resistor.

12. The liquid crystal display device as defined in claim 1, wherein:

the control means changes the data voltage applied to the signal electrode to a level differing from a first level corresponding to data to be displayed on the liquid crystal panel only for a predetermined duration at the beginning of each driving period excluding the first driving period, when display data of the same level continues over a plurality of driving periods.

13. A liquid crystal display comprising:

a liquid crystal panel having a plurality of signal electrodes and a plurality of scanning electrodes that are disposed in an intersecting manner with a liquid crystal layer sandwiched in between;

signal-side driving means for applying data voltages representative of data to be displayed on the liquid crystal panel to the signal electrodes;

scanning-side driving means for successively applying scanning voltages to the scanning electrodes for a set driving period;

distortion-eliminating means for shaping a waveform of a scanning voltage so as to eliminate a waveform distortion of the scanning voltage which is induced with respect to non-selected scanning electrodes due to a transient response to ON/OFF switching of the data voltages;

control means for controlling application of the data voltages by the signal-side driving means so that amounts of roundness of the voltages respectively applied to the signal electrodes are substantially the same; and wherein the corresponding data voltage changes to a level differing from a first level corresponding to data to be displayed on the liquid crystal panel only for a predetermined duration at the beginning of each driving period excluding a driving period, when display data of the same level continues over a plurality of driving periods.

* * * * *